US005757168A

United States Patent [19]

DeVale

[11] Patent Number: 5,757,168

[45] Date of Patent: May 26, 1998

[54] PRIMARY REGULATOR FOR AN UNREGULATED LINEAR POWER SUPPLY AND METHOD

[75] Inventor: Donald P. DeVale, Bloomingdale, Ill.

[73] Assignee: American Manufacturing & Technologies, Incorporated, Addison, Ill.

[21] Appl. No.: 643,729

[22] Filed: May 6, 1996

[51] Int. Cl.[6] ..... G05F 1/40

[52] U.S. Cl. ..... 323/235; 323/274; 323/319

[58] Field of Search ..... 323/234, 235, 323/237, 241, 273, 274, 275, 282, 283, 284, 285, 319, 320, 322, 323, 349, 350, 351

[56] References Cited

U.S. PATENT DOCUMENTS 4,438,385 3/1984 Sato et al. ..... 322/28

5,053,596 10/1991 Storm et al. ..... 323/319 X 5,283,516 2/1994 Lohoff ..... 323/322

OTHER PUBLICATIONS

Excerpt of Crydom parts catalogue belived to have been published prior to May 6, 1996.

*Primary Examiner*—Peter S. Wong

*Assistant Examiner*—Y. J. Han

*Attorney, Agent, or Firm*—Brinks Hofer Gilson & Lione

[57] ABSTRACT

A primary regulator having a zero-crossing detector and a voltage reference coupled to a processor is provided. The processor controls the on time of a primary transformer via a switching device isolated from the processor via a coupler A method of regulating a power supply to maintain a desired output voltage at a load including the steps of measuring an average output voltage at a load and controlling the on time of a switching device serially connected to a primary transformer input based on the measured output voltage and a zero-crossing signal.

10 Claims, 5 Drawing Sheets

PRIMARY REGULATOR FOR AN UNREGULATED LINEAR POWER SUPPLY AND METHOD

BACKGROUND OF THE INVENTION

This invention relates to an improved regulated power supply. More particularly, the present invention relates to a primary regulator for an unregulated linear power supply that is cost efficient for high power output requirements and is relatively insensitive to changes in source voltage and load.

Power supplies find usefulness in any electrical system where the system requires consistent and repeatable power supplied to its circuits. Various types of power supplies exist and are in use for specific applications. Linear power supplies provide a simple low cost way of providing a regulated power supply to a device Although linear regulators are relatively simple to implement compared to other type of power supplies and generate very little radio frequency (RF) noise, they are usually inefficient. Linear regulators tend to generate a great deal of heat and require large heat sinks. As a result, linear regulators are often used in lower power applications because of the larger, heavier heat sinks required to cool the regulator in high power applications.

Switch mode power supplies are another common type of regulated power supply used to provide desired amounts of current or voltage to a load. Switch mode power supplies generally operate by using a power transistor in a non-linear (i.e., saturated or cut-off) state. Modulating an input voltage by shutting on and off the power transistor allows a switch mode power supply to control the DC output generated by controlling the pulse width of the pulses created. Although switch mode power supplies have a higher efficiency, smaller size and lower weight than linear regulators, switch mode converters tend to generate RF interference due to the switching action of the power transistor. Additionally, the cost of switch mode power supplies escalates rapidly as the power supply requirements exceed 100 watts. In particular, traditional switch mode power supplies require more expensive inductors and transistors to handle the increased current and voltage peaks generated in higher power applications.

Accordingly, there is a need for an improved power supply regulator that is efficient and cost effective for high power requirements. A high power output regulated power supply is needed that will provide accurate output voltages for variations in the input voltage and load values while isolating the higher voltage of the input from the lower output voltage.

SUMMARY OF THE INVENTION

The present invention provides for an improved regulator for a linear power supply for use in high power applications. An embodiment of the present invention includes a regulator having a transformer for receiving a variable supply voltage. The transformer is coupled to a full-wave rectifier, a voltage reference and a zero-crossing detector. A processor is also coupled to the zero-crossing detector and the voltage reference. The processor is further coupled to a load voltage sense line and a switch. The switch is coupled to a primary transformer and is controlled by the processor to switch the primary transformer on and off for predetermined periods of time in response to signals from the processor. In one embodiment, the switch is a triac and the processor is a microprocessor that may calculate a time delay factor with a first routine for use in controlling the triac.

According to a second aspect of the present invention, a method is provided for regulating a power supply output voltage. A supply voltage is sensed with a processor to detect zero-crossings. After detecting a zero-crossing, the processor measures the voltage on the load voltage sense line. A primary transformer connected to a load is controlled by the processor to conduct current for predetermined intervals so that a substantially constant output voltage is maintained. Preferably, the processor controls the voltage to the load by switching a triac on and off based on the measured load voltage and sensed zero-crossings.

The invention itself; together with further attendant advantages, will best be understood by reference to the following detailed description taken in conjunction with the accompanying drawings.

DETAILED DESCRIPTION OF THE PRESENTLY PREFERRED EMBODIMENTS

Figure 1:
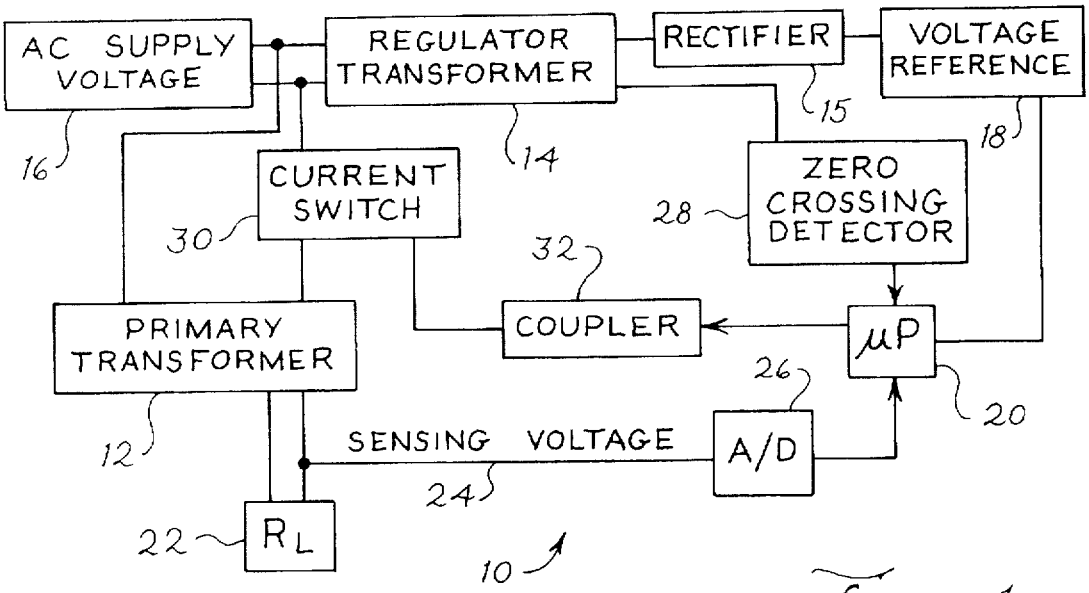
FIG. 1 is a block diagram of a preferred primary regulator for an unregulated linear power supply according to the present invention.

Referring to FIG. 1, a preferred primary regulator 10 is shown. The power supply includes a primary, or load, transformer 12 and a regulator transformer 14 coupled to an unregulated alternating current (AC) supply voltage source 16. The primary transformer 12 may be any of a number of known power transformer circuits rated for the desired voltage and current range. The regulator transformer 14 steps down the AC supply voltage 16. The stepped down voltage is presented to a rectifier 15 which rectifies the AC signal into a direct current (DC) voltage that powers a voltage reference device 18. The voltage reference device 18 produces a predetermined precision reference voltage for use by the processor 20 in regulating the load voltage presented to a load 22 by the primary transformer 12. The processor 20 also receives a load voltage signal from an analog-to-digital (A/D) converter 26 and a zero crossing signal from a zero crossing detector 28. The zero crossing detector is preferably coupled to the regulator transformer and emits a signal every time the sinusoidal supply voltage makes a zero crossing.

In operation, the processor 20 uses the signal from the zero crossing detector 28 to establish a time zero. The processor 20 also uses the A/D converter 26 to measure the sense voltage from the load. With these two pieces of information, the processor phase controls a current switch 30 which in turn controls the duty cycle of the AC supply voltage presented to the primary transformer 12. If the processor senses, via the sensing voltage line 24, that the load voltage is too high, the microprocessor decreases the on time of the current switch 30 by a command passed to the current switch via a coupler 32. If the voltage sensed is too low, the processor 20 increases the on time of the current switch so that a greater percentage of the AC supply voltage is supplied to the primary transformer 12. The presently preferred primary regulated power supply is also insensitive to changes in the input voltage. When the input voltage is increased, the processor senses an increase at the load and decreases the on time of the current switch 30.

Figure 2:
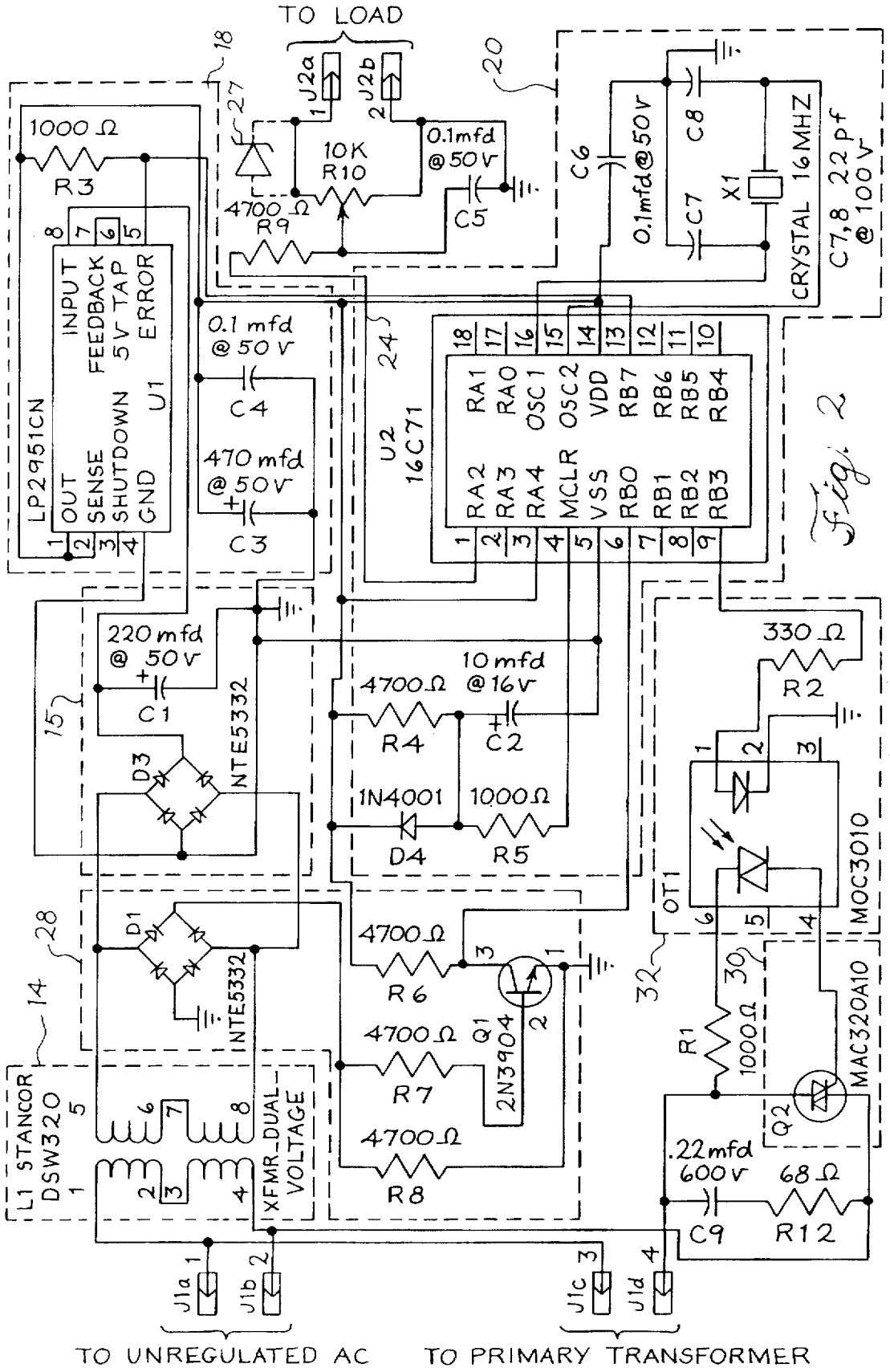
FIG. 2 is a circuit diagram illustrating a preferred embodiment of the regulator elements of FIG. 1.

Referring to FIG. 2, a preferred embodiment of several portions of the regulator 10 of FIG. 1 are shown in greater detail. The regulator transformer 14 may be a dual voltage transformer such as a Stancor DSW 320 dual voltage transformer for stepping down the voltage from an AC supply to the regulator circuitry. In one preferred embodiment the AC supply voltage may be in the range of 40 to 240 volts. The regulator transformer 14 acts to isolate the supply voltage from the rest of the regulator 10. The rectifier 15 may be implemented with a diode bridge D3 such as an NTE5332 diode bridge manufactured by NTE, Inc. and a shunt capacitor C1 designed to minimize residual ripple.

The rectified output of the rectifier circuitry 15 is preferably input into a voltage reference 18 which may be implemented as an integrated circuit precision voltage reference U1. A five volt precision voltage reference such as the LP2951CN manufactured by National Semiconductor is suitable for use in a presently preferred embodiment. The precision voltage reference U1 provides a five volt reference signal filtered for any residual ripple by two filter capacitors C3, C4 shunted to ground. The precision voltage reference U1 also outputs an error signal if it is unable to produce a five volt output. An error signal will cause the processor 20 to shut down to avoid erroneous load voltages.

A preferred processor 20 is a circuit including a microprocessor U2, a clock circuit comprising a crystal oscillator X1 and resonating capacitors C6, C7 and C8, and reset circuitry R5, C2, R4 and D4. An appropriate microprocessor is a 16C71 microprocessor manufactured by Microchip Technologies, Inc. which includes a built-in A/D converter and programmable memory. As will be understood by those of ordinary skill in the arts a discrete A/D converter and a discrete processor may be used in place of the integrated processor and A/D converter shown in FIG. 2. The clock circuit is designed such that the crystal X1 and capacitors C6–C8 create a desired clock frequency. In the embodiment shown in FIG. 2, the clock circuit provides a 16 MHz signal to the microprocessor U2.

The microprocessor receives the precision 5 Volt DC voltage generated at the voltage reference 18 and utilizes this voltage both as a power supply and as a reference voltage to compare with the load voltage detected on the sensing voltage line 24 with the A/D converter. The reset circuitry (R4, R5, C2, D4) acts to hold the microprocessor U2 off, during initial power on or a reset, until the supply voltage reaches 5 Volts. By ensuring that the microprocessor does not turn on until the supply voltage reaches 5 Volts, microprocessor false starts are avoided.

As shown in FIG. 2, a preferred zero-crossing detector 28 may include a bridge rectifier D1 coupled to the regulator transformer 14. The rectifier D1 is in series with a resistor R8 so that a relatively undistorted full wave rectified signal is presented to transistor Q1. The transistor Q1 is preferably biased with resistors R6, R7, and R8 so that the transistor Q1 generates a square wave output from the rectified signal received at its base terminal. This square or pulse signal produced by the zero-crossing detector 28 is the fed into the microprocessor U2. A suitable transistor is a 2N3904 NPN transistor available from Motorola, Inc. As is evident to those of ordinary skill in the art, other circuitry configurations may be used to generate a signal in response to a zero-crossing of a sine wave.

The processor 20 is coupled to a switching device 30 by a coupler 32. The coupler 32 may be an optical coupler or other type of high isolation coupling device, such as a pulse transformer, that isolates the processor 20 and the rest of the regulator circuitry from the high voltages and currents of the primary transformer 12. One preferred coupler 32 is a MOC3010 optical coupler manufactured by Motorola, Inc. The switching device 30 may be a triac Q2 such as the MAC320A10 available from Motorola, Inc. The triac Q2, in response to pulsed signals from the processor 20, controls the flow of current through the primary transformer (not shown) attached to connectors J1*c* and J1*d*. In the embodiment illustrated in FIG. 2, a resistance R1 is in series with the triac Q2 and the optical coupler OT1 and a series resistor R12 and capacitor C9 are in parallel with the primary transformer. R12 and C9 form a dv/dt snubber that helps reduce transformer kickback from the primary transformer 12 that may occur when the transformer is shut off while powering an inductive load.

The processor 20, via the A/D converter, reads the voltage at the load through connectors J2*a* and J2*b*. A resistor R9 and potentiometer R10, are selected so that the potentiometer can be adjusted to divide the desired load voltage to a predetermined voltage that is a portion of, and preferably half, the reference voltage generated by the voltage reference stage 18. In the embodiment shown in FIG. 2, the load voltage is divided down to 2.5 Volts. Thus, the voltage sensing line 24 presents 2.5 Volts DC to the processor 20 via an A/D converter 26 when the load voltage is at the desired level. In operation, the processor 20 compares the divided load voltage against the reference voltage.

In another preferred embodiment, a zener diode 27 may be placed in series between the potentiometer R10 and the positive terminal J2*a* connected to the load instead of directly connecting the potentiometer to the positive terminal. Placing a zener diode 27 in series with the potentiometer, such that the anode of the zener diode is connected to the potentiometer, improves the sensitivity of the regulator to changes in the output voltage at the load. When the regulator does not include the zener diode 27, the potentiometer divides the output voltage, and thus also divides any changes in the output voltage that are presented to the A/D converter. By placing a zener diode in series with the potentiometer, the output voltage presented to the potentiometer is reduced without dividing the magnitude of the output voltage changes so that the potentiometer may be set to a lower dividing ratio. In this manner, the zener diode effectively increases the magnitude of the voltage changes measured at the A/D converter in comparison to dividing down the entire output voltage. Any available zener diode having suitable power ratings for the desired application may be used.

Figure 5:
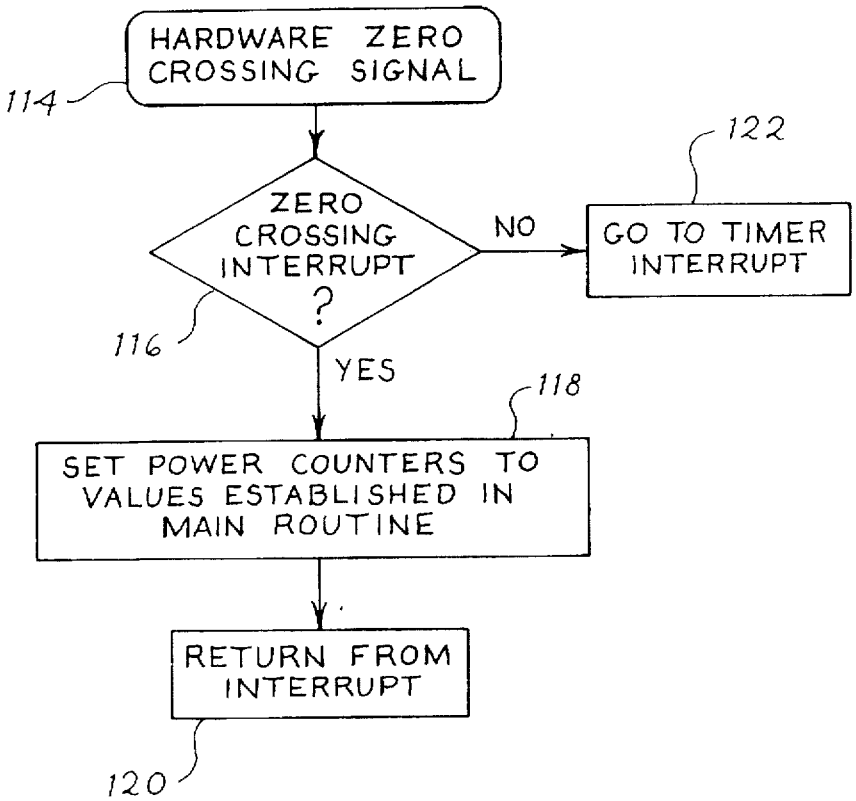
FIG. 5 is a flow chart of a preferred timer interrupt method for use with the method of FIGS. 3A and 3B.
Figure 3A:
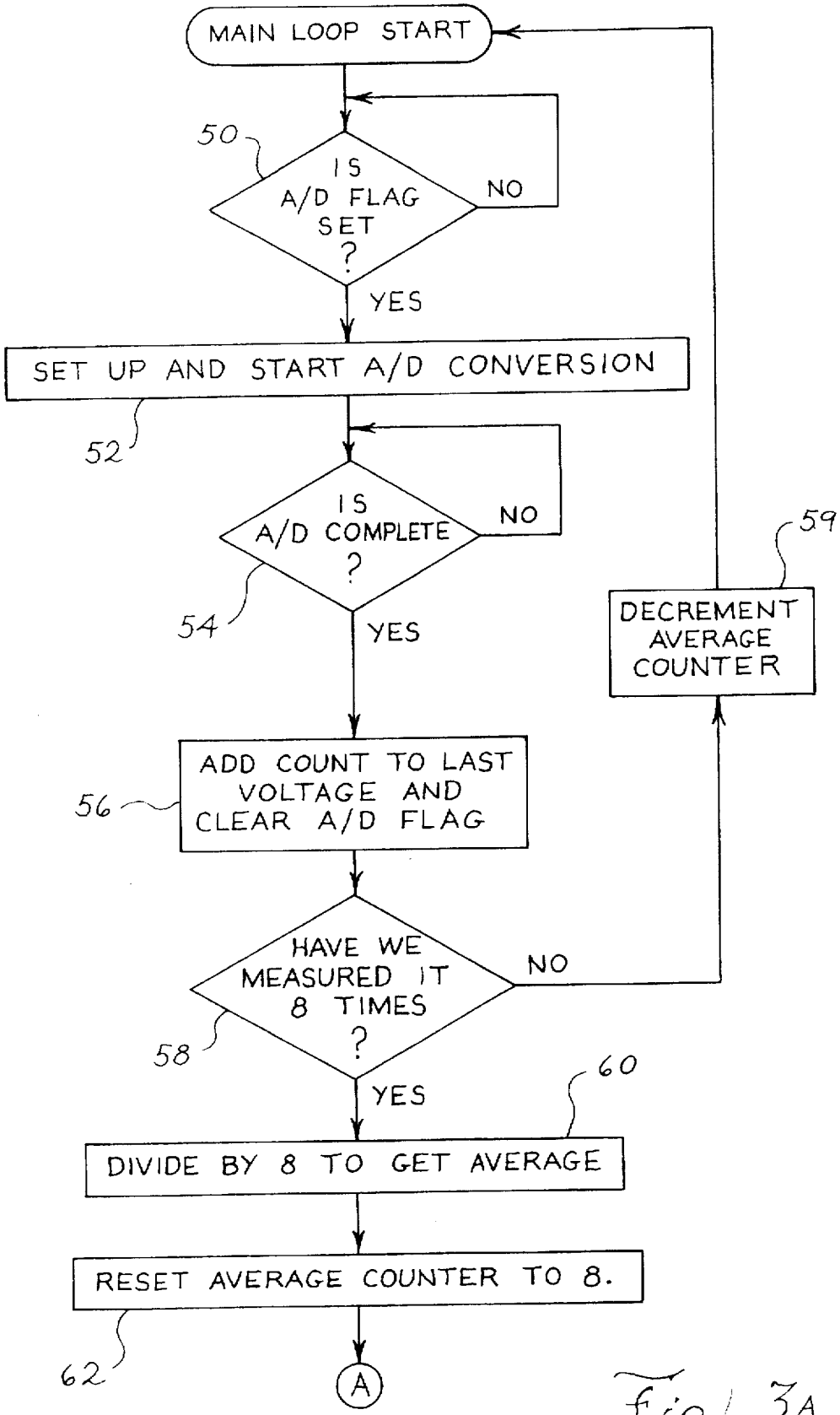
FIG. 3A is a flow chart showing a preferred method of regulating a power supply output voltage.
Figure 3B:
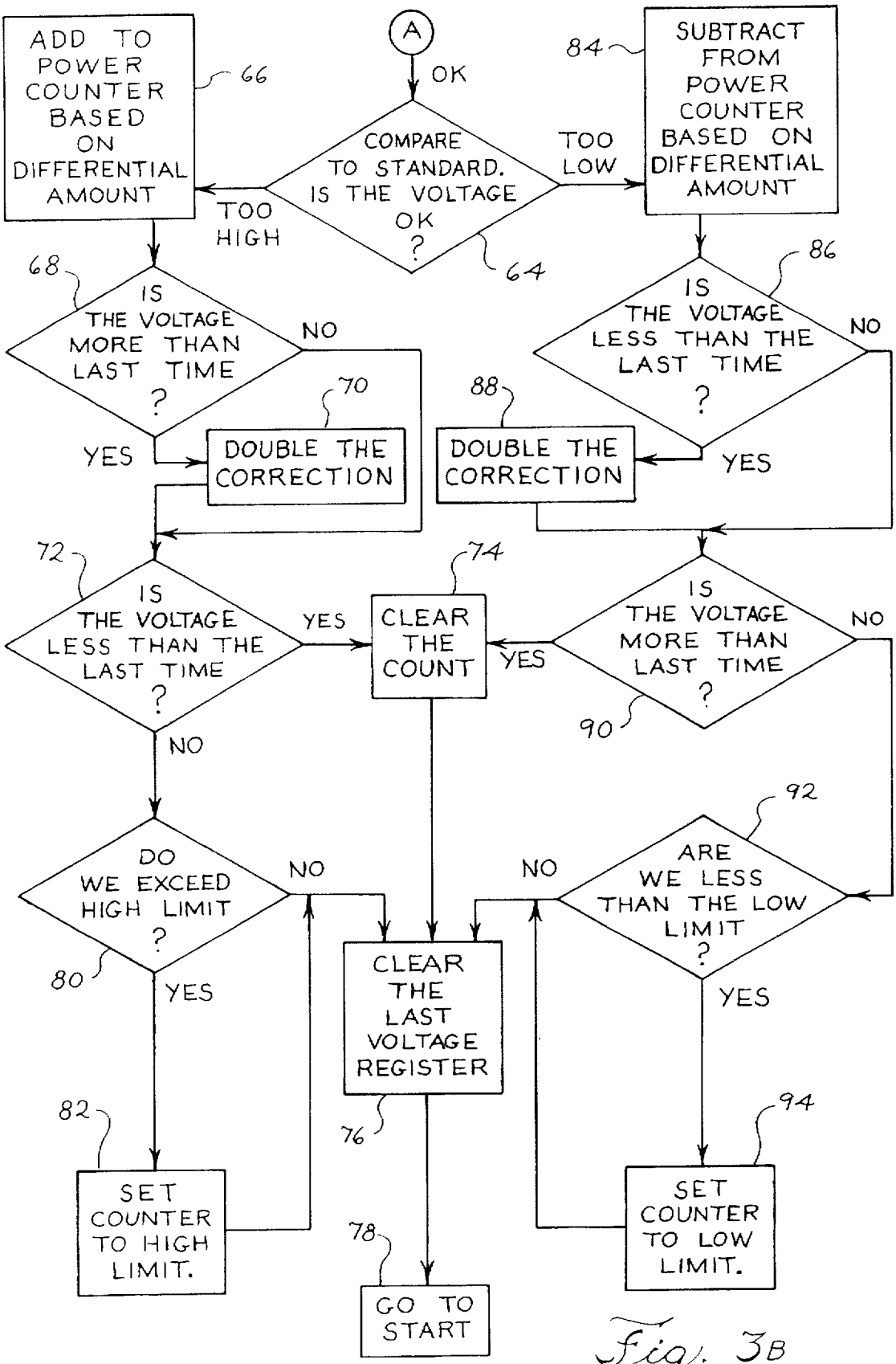
FIG. 3B is a continuation of the flow chart of FIG. 3A.
Figure 4:
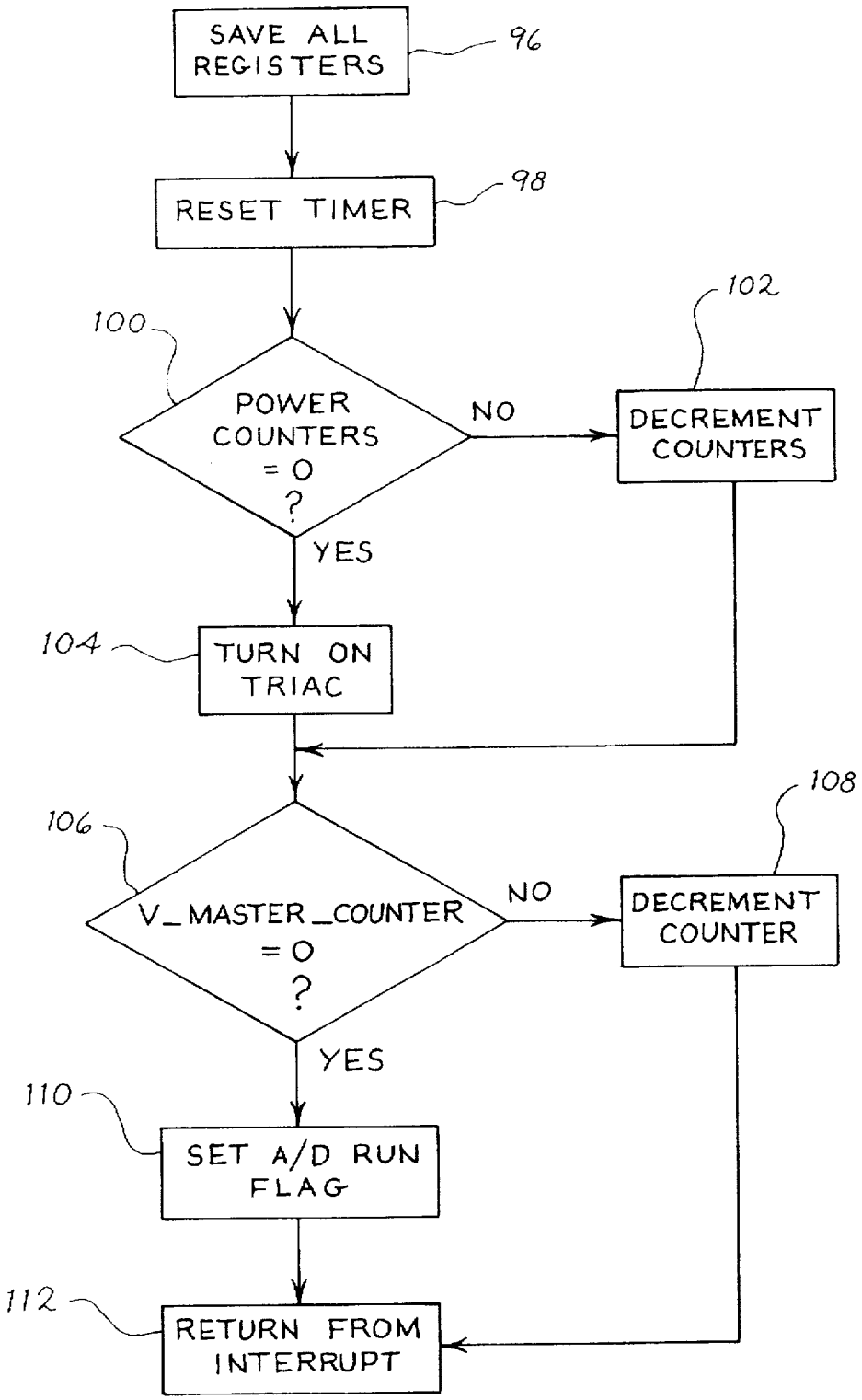
FIG. 4 is a flow chart illustrating a preferred zero crossing detection method for use with the method of FIGS. 3A and 3B.

FIGS. 3–5 illustrate one preferred method of regulating an output voltage for a range of input voltages and loads using the regulated power supply described above. This method may be implemented as a set of instructions stored in and executed by the microprocessor U2 described above. A listing of source code, written in machine language using a Microchip Technologies assembler compiler, is found in Appendix A.

FIGS. 3A and 3B illustrate the steps taken by the primary regulator 10 described above to determine whether the output voltage to the load is above or below the desired level. Preferably, the primary regulator samples the load voltage eight times during each 180° of the input supply voltage cycle. Assuming that the input supply voltage is operating at the U.S. standard 60 Hz, the primary regulator samples the voltage at the load eight times every 8.33 milliseconds. In other preferred embodiments, the sampling rate for sampling the output voltage at the load may be increased or decreased depending on system requirements and other AC input supply voltage frequencies, such as the 50 Hz supplies of european countries, may also be used.

As shown in FIG. 3A the regulator 10 checks to see that an A/D flag is set so that the A/D converter can begin sampling the load voltage (at step 50). If the A/D flag is not set, the microprocessor continues checking for this flag until the timer interrupt sequence, described below, interrupts the microprocessors, determines that another load voltage measurement is necessary, and resets the A/D flag. Assuming that the flag is set, the A/D converter begins conversion of the voltage on the load voltage sensing line 24 (at step 52). After completing the A/D conversion, the value obtained is added to a Last Voltage variable in memory and the A/D flag is cleared (at steps 54 and 56). The microprocessor checks whether the predetermined number of load voltage measurements have been made (at step 58). If the number of measurements is less than the predetermined amount, the microprocessor U2 decrements an Average Counter and returns to checking the A/D flag (at step 59).

If the predetermined number of measurements have been made, the measurements are averaged by dividing the sum of output voltage measurements by the predetermined number of measurements made (at step 60). In one preferred embodiment, eight measurements are made and averaged for every 180° of the input supply voltage. After the last measurement, the Average Counter is reset to eight and the microprocessor compares the average measured voltage to the voltage provided by the precision voltage reference U1 (at steps 62 and 64).

If the average output voltage is greater than the reference voltage, the microprocessor U2 makes a correction to the Power Counter variable. The correction is a variable predetermined value added to the Power counter based on the difference between the measured average output voltage and the reference voltage (at step 66). The microprocessor then determines whether the present average output voltage is greater than the previous average output voltage (at step 68). If the present average output voltage is greater than the previous average voltage, the microprocessor doubles the correction to the Power Counter variable (at step 70). By doubling the correction to the Power Counter variable, the regulator can react more rapidly to sudden changes in the load such as when the load is removed.

If the present average output voltage is less than the previous average output voltage, the microprocessor clears the memory register containing the Power Counter correction (at steps 72 and 74). The microprocessor also clears the Last Voltage register, which contains the sum of the eight voltage samples from the previous measurement, and returns to an initial state (at steps 74, 76, and 78). If the present voltage is less than the previous value, the microprocessor checks to see if the Power Counter value is set above its maximum limit (at steps 72 and 80). The Power Counter is set to its highest value if the added correction exceeds the maximum limit for the Power Counter (at step 82).

In contrast, when the average output voltage is lower than the voltage reference, the microprocessor subtracts a predetermined amount from the Power Counter register (FIG. 3B, at step 84). If the present average output voltage is less than the previous average, the correction is doubled (at steps 86 and 88). Preferably, the correction is doubled by doubling the predetermined amount that the microprocessor will subtract from the Power Counter. If the present output voltage is more than the previous output voltage, the microprocessor clears the correction count register, clears the Last Voltage register, and returns to an initial state to begin the process of measuring and adjusting the output voltage (at steps 90, 74–78). If the correction to be subtracted from the Power Counter would drop the Power Counter below its minimum allowed value, the microprocessor sets the Power Counter to the minimum allowed value (at steps 92 and 94).

The Power Counter variable represents the period of time for each 180° of the unregulated AC supply voltage that the microprocessor waits before turning the triac Q2 on and allowing current to flow in the primary transformer 12. Each 180° of the unregulated AC input supply voltage, at 60 Hz, takes 8.33 milliseconds. This 8.33 milliseconds is broken up into a plurality of equal length time increments. In one preferred embodiment, the number of increments for every 180° of the input sine wave is 768. Thus, the maximum value for the Power Counter would be 768 or approximately 11 microseconds per time increment (8.33/768). Other combinations of time increments and Power Counter values may be used depending upon the desired level of output voltage accuracy desired. The smaller the time increment chosen, the finer the output voltage tuning capability.

FIG. 4 shows a preferred timer interrupt for use with the method shown in FIGS. 3A and 3B. In one preferred embodiment, the time increment is approximately 11 microseconds so that the timer interrupt occurs at approximately 11 microsecond intervals. After each time increment, the microprocessor U2 saves all present variable values and resets its internal timer (at steps 96 and 98). Next, the value of the Power Counter variable is checked (at step 100). If the Power Counter, which was determined as described above, is a non-zero value, the microprocessor decrements the Power Counter by one (at step 102). As long as the Power Counter variable is non-zero, the triac Q2 remains off. If the Power Counter value is zero then the microprocessor U2 turns on the triac Q2 by sending a signal, such as a single electrical pulse, to the triac Q2 through the optical coupler OT1 (at step 104). Thus, the Power Counter variable contains the amount of time that the triac is to remain off every 180° of the input supply voltage swing.

The triac conducts from the time it receives the single pulse from the microprocessor until approximately the time that the unregulated AC input supply voltage reaches a zero crossing. At the zero crossing, the triac automatically shuts down thereby cutting off the flow of current to the load transformer. Because of turn off delays inherent in triacs, SCRs, and other switching devices that may be used for this purpose, a predetermined number of time increments at the beginning of each 180° of the input voltage are set aside to insure that the switching device turns off fully from the previous 180° cycle. For a triac, the appropriate settling time is 128 time increments (approximately 1.2 milliseconds). The settling time insures that the current in the transformer shuts off completely so that the triac, which only shuts off when the current shuts off, can turn off.

After the Power Counter is decremented, or the triac is turned on, the microprocessor checks the output voltage sample counter (V_master_counter) (at step 106). The V_master_counter is a separate counter that contains the number of time increments between taking output voltage samples. When the output voltage sample counter is non-zero, the microprocessor decrements the counter and returns from the timer interrupt to the process of FIG. 3 (at steps 108 and 112). If the output voltage sample counter is zero, then the A/D flag is set and the timer interrupt is exited (at steps 110 and 112). As described above, the A/D flag is used by the microprocessor to inform the A/D converter to take a sample of the output voltage.

FIG. 5 illustrates a preferred zero-crossing interrupt method useful with the method of FIGS. 3–4. When the sinusoidal input supply voltage passes through a zero, the zero-crossing detector 28 produces a signal that is transmitted to the microprocessor U2 (at step 114). At a predetermined point in the signal produced by the zero-crossing detector, preferably the falling edge of the square wave generated at transistor Q1, the microprocessor U2 recognizes a zero-crossing interrupt and sets the Power Counter variable to the value most recently established in the method of FIGS. 3A and 3B described above (at steps 116 and 118). The microprocessor then returns from the zero-crossing interrupt to the process of comparing the measured output load voltage and the reference voltage (at step 120). If the signal received from the zero-crossing detector is not a zero-crossing interrupt, the microprocessor executes the timer interrupt process described in FIG. 4.

In one embodiment, an output voltage at the load of a primary transformer may be regulated to within 0.005 Volts when the Power Counter variable is set to 768. By setting the Power Counter to 768, each 180° of a 60 Hz unregulated AC input supply voltage is divided up into 768 segments, or time increments, of approximately 11 microseconds each. Using the preferred regulated power supply controller and method, the on time of a triac may be controlled by the microprocessor in increments of approximately 11 microseconds, equal to 0.28° of the unregulated input voltage's sine wave, such that a 0.005 Volt adjustment may be made at the output of a primary transformer Larger adjustments to the on time of the triac may be made as needed to compensate for larger variations of the load voltage measured by the A/D converter.

In one embodiment, the regulator may be used to take an unregulated input voltage of 80 to 240 VAC and phase control the primary transformer to supply 30V to a load. The presently preferred regulator may handle power requirements of up to 1 kilowatt. By changing the potentiometer (R10 in FIG. 2) used to divide down the load voltage on the voltage sense line to a higher power handling potentiometer, the output voltage levels may be increased. By using a triac, or other type of current switch, with a higher current capacity and using a larger heat sink, the regulator's power handling capability may be increased to levels above 1 kilowatt. Increasing the unregulated AC input voltage to above 240 VAC may also be accommodated through substitution of a higher voltage rated triac or other type of switch.

From the foregoing, an improved power supply regulator and method of regulating load voltages in high power environments has been described. The power supply regulator controller includes a processor using a first routine for controlling a current switching device based on information from a voltage reference, a zero-crossing detector, and a sensing voltage measurement. A regulator transformer and a coupler isolate the power supply regulator controller from the high power of the unregulated AC power supply. Additionally, a method for regulating a load voltage has been described that is useful for accurately regulating a load voltage in high power applications.

It is intended that the foregoing detailed description be regarded as illustrative rather than limiting, and that it be understood that the following claims, including all equivalents, are intended to define the scope of this invention.

Case No. 7168/4

IN THE UNITED STATES PATENT AND TRADEMARK OFFICE
APPLICATION FOR UNITED STATES LETTERS PATENT

APPENDIX A
Source Code for Microprocessor

INVENTOR: Donald P. DeVale

TITLE: PRIMARY REGULATOR FOR AN UNREGULATED LINEAR POWER SUPPLY AND METHOD

ATTORNEYS: Frank J. Kozak
Kent E. Genin
BRINKS HOFER GILSON & LIONE
P. O. Box 10395
Chicago, Illinois 60610
(312) 321-4200

```
16c5x/xx Cross-Assembler V4.14 Released  Tue Apr 30 13:11:47 1996  Page 1
Power51.asm Rev 1.0  Primary Regulator

Line   PC    Opcode

0001               ;9/19/95
0002               ;Power Supply Software
0003               ;Last Revision 4/30/96
0004               ;Copyright 1995,1996
0005               ;American Manufacturing & Technologies, Inc.
0006               ;All rights reserved
0007               ;Author Don DeVale
0008               LIST N=57, C=84, f=INHX8M, r=dec, p=16C71
0009               ;
0010         0001  RTCC            equ     01h
0011         0003  STATUS          equ     03h
0012         0002  Z               equ     02h
0013         0000  C               equ     0h
0014         0005  Port_A          equ     05h
0015               ;
0016         0006  Port_B          equ     06h
0017         0003  Vmain           equ     03h;Port_B,RB3
0018         0007  V1_Power        equ     07h;RB7
0019         0006  V2_Power        equ     06h;RB6
0020         0001  Vtest_1             equ       01h
0021         0002  Vtest_2             equ       02h
0022         0004  Vtest_4             equ       04h
0023         0005  Vtest_5             equ       05h
0024               ;
0025         0005  Tris_A          equ     05h; page 1
0026         0006  Tris_B          equ     06h; page 1
0027               ;
0028         0008  Adcon0          equ     08h
0029         0001  ADIF            equ     01h; a/d finish bit
0030         0002  GO_BIT          EQU     02h
0031         0002  DONE            equ     02h
0032               ;
0033         0009  Adres           equ     09h;a/d result reg
0034         0008  Adcon1          equ     08h; page 1
0035         000B  Intcon          equ     0Bh
0036         0001  INTF            equ     01h;zero crossing interupt flag
0037         0002  T0IF            equ     02h
0038         0001  Ropt            equ     01h;Option in page 1
0039         0005  Page_1          equ     05h
0040         00E4  Set_RTCC        equ     228
0041         0001  Reaction_Set    equ     1
0042               ;
0043         000C  Reg_C           equ     0Ch; bit register
0044         0000  PWR_ON_FLAG     equ     0h ; bit0
0045         0001  RUN_AD          equ     1h ; check A/A flag
0046         0002  POWER_ONE_FLAG  equ     2H
0047         0003  POWER_TWO_FLAG  equ     3H
0048         0004  POWER_AVAILABLE EQU     4h
0049               ;
0050         000D  Time_Thru       equ     0Dh
0051         000E  Power_Counter   equ     0Eh
0052         000F  Power_Set       equ     0Fh
0053         0010  Power_Two_Set   equ     10h
0054         0011  Power_Two       equ     11h
0055         0012  V_Master_Ctr    equ     12h
0056         0013  Last_Amount     equ     13h
0057         0014  Amount_Mag      equ     14h
```

16c5x/xx Cross-Assembler V4.14 Released Tue Apr 30 13:11:47 1996 Page 2

```
Line   PC    Opcode

0058         0015  Save_Status     equ     15h
0059         0016  Save_W          equ     16h
0060         0017  Timer           equ     17h
0061         0018  Base_Counter    equ     18h
0062         0019  Last_Voltage    equ     19h
0063         001A  Hi_Voltage          equ       1Ah
0064         001B  Avg_Counter         equ       1Bh
0065         001C  Power_One           equ       1Ch
0066         001D  Amount              equ       1Dh
0067         001E  Power_One_Set       equ       1Eh
0068               ;                   equ       1Fh
0069               ;
0070   0000  2805            goto      init
0071   0001  0000            nop
0072   0002  0000            nop
0073   0003  0000            nop
0074   0004  282C            goto      int0
0075   0005  0100  init      clrw
0076   0006  008C            movwf     Reg_C
0077   0007  008D            movwf     Time_Thru
0078   0008  1683            bsf       STATUS,Page_1
0079   0009  301F            movlw     00011111B
0080   000A  0085            movwf     Tris_A
0081   000B  3001            movlw     00000001B; corrected 9/20/95/:09:35
0082   000C  0086            movwf     Tris_B
0083   000D  3089            movlw     10001001B
0084   000E  0081            movwf     Ropt
0085   000F  0188            clrf      Adcon1
0086   0010  1283            bcf       STATUS,Page_1
0087   0011  0186            clrf      Port_B
0088   0012  30FF            movlw     0ffH
0089   0013  008E            movwf     Power_Counter
0090   0014  009E            movwf     Power_One_Set
0091   0015  009C            movwf     Power_One
0092   0016  008F            movwf     Power_Set
0093   0017  3080            movlw     80H
0094   0018  0090            movwf     Power_Two_Set
0095   0019  0091            movwf     Power_Two
0096   001A  3032            movlw     50
0097   001B  0092            movwf     V_Master_Ctr
0098   001C  30C1            movlw     193
0099   001D  0098            movwf     Base_Counter
0100   001E  019A            clrf      Hi_Voltage
0101   001F  0199            clrf      Last_Voltage
0102   0020  3008            movlw     8
0103   0021  009B            movwf     Avg_Counter
0104   0022  1186            bcf       Port_B,Vmain
0105   0023  30B0            movlw     10110000B;enable interupts
0106   0024  008B            movwf     Intcon
0107   0025  2872            goto      start
0108               ;
0109   0026  3014  wait_20    movlw     20
0110   0027  0097            movwf     Timer
0111   0028  0000  wt_20     nop
0112   0029  0B97            decfsz    Timer
0113   002A  2828            goto      wt_20
0114   002B  0008            return
```

16c5x/xx Cross-Assembler V4.14 Released Tue Apr 30 13:11:47 1996 Page 3

```
Line   PC    Opcode
0115                        ;
0116   002C  0096  int0     movwf   Save_W
0117   002D  0803           movf    STATUS,0
0118   002E  0095           movwf   Save_Status
0119   002F  30E4           movlw   Set_RTCC
0120   0030  0081           movwf   RTCC
0121   0031  188B           btfsc   Intcon,INTF
0122   0032  284E           goto    set_0
0123   0033  1506           bsf     Port_B,Vtest_2
0124   0034  180C           btfsc   Reg_C,PWR_ON_FLAG
0125   0035  2866           goto    sta_off
0126   0036  0818           movf    Base_Counter,0
0127   0037  1903           btfsc   STATUS,Z
0128   0038  283C           goto    int11
0129   0039  0398           decf    Base_Counter,1
0130   003A  1186           bcf     Port_B,Vmain
0131   003B  2867           goto    intend
0132   003C  0811  int11    movf    Power_Two,0
0133   003D  1903           btfsc   STATUS,Z
0134   003E  2842           goto    int12
0135   003F  0098           movwf   Base_Counter
0136   0040  0191           clrf    Power_Two
0137   0041  2867           goto    intend
0138   0042  081C  int12    movf    Power_One,0
0139   0043  1903           btfsc   STATUS,Z
0140   0044  2848           goto    int10
0141   0045  0098           movwf   Base_Counter
0142   0046  019C           clrf    Power_One
0143   0047  2867           goto    intend
0144   0048  080E  int10    movf    Power_Counter,0
0145   0049  1903           btfsc   STATUS,Z
0146   004A  285E           goto    turn_on
0147   004B  0098           movwf   Base_Counter
0148   004C  018E           clrf    Power_Counter
0149   004D  2867           goto    intend
0150   004E  1486  set_0    bsf     Port_B,Vtest_1
0151   004F  080F           movf    Power_Set,0
0152   0050  008E           movwf   Power_Counter
0153   0051  081E           movf    Power_One_Set,0
0154   0052  009C           movwf   Power_One
0155   0053  0810           movf    Power_Two_Set,0
0156   0054  0091           movwf   Power_Two
0157   0055  30C1           movlw   193
0158   0056  0098           movwf   Base_Counter
0159   0057  3032           movlw   50
0160   0058  0092           movwf   V_Master_Ctr
0161   0059  160C           bsf     Reg_C,POWER_AVAILABLE
0162   005A  100C           bcf     Reg_C,PWR_ON_FLAG
0163   005B  1086           bcf     Port_B,Vtest_1
0164   005C  108B           bcf     Intcon,INTF
0165   005D  286D           goto    endit0
0166   005E  1806  turn_on  btfsc   Port_B,0
0167   005F  2865           goto    sta_off_now
0168   0060  180C           btfsc   Reg_C,PWR_ON_FLAG
0169   0061  2866           goto    sta_off
0170   0062  1586           bsf     Port_B,Vmain
0171   0063  140C           bsf     Reg_C,PWR_ON_FLAG
```

16c5x/xx Cross-Assembler V4.14 Released Tue Apr 30 13:11:47 1996 Page 4

```
Line   PC    Opcode
0172   0064  2867              goto      intend
0173                sta_off_now
0174   0065  140C              bsf       Reg_C,PWR_ON_FLAG
0175   0066  1186  sta_off     bcf       Port_B,Vmain
0176   0067  0B92  intend      decfsz    V_Master_Ctr,1
0177   0068  286C              goto      endit
0178   0069  3068              movlw     104
0179   006A  0092              movwf     V_Master_Ctr
0180   006B  148C              bsf       Reg_C,RUN_AD
0181   006C  110B  endit       bcf       Intcon,T0IF
0182   006D  0815  endit0      movf      Save_Status,0
0183   006E  0083              movwf     STATUS
0184   006F  0816              movf      Save_W,0
0185   0070  1106              bcf       Port_B,Vtest_2
0186   0071  0009              retfie
0187                ;
0188   0072  1C8C  start       btfss     Reg_C,RUN_AD
0189   0073  2872              goto      start
0190   0074  108C              bcf       Reg_C,RUN_AD
0191   0075  0064              clrwdt
0192   0076  1606              bsf       Port_B,Vtest_4
0193   0077  3091              movlw     10010001B
0194   0078  0088              movwf     Adcon0; set Vmain A/D & start
0195   0079  2026              call      wait_20
0196   007A  1508              bsf       Adcon0,GO_BIT
0197   007B  1908  vmrun       btfsc     Adcon0,DONE
0198   007C  287B              goto      vmrun
0199   007D  0809              movf      Adres,0
0200   007E  0799              addwf     Last_Voltage,1
0201   007F  1C03              btfss     STATUS,C
0202   0080  2882              goto      vmrun0
0203   0081  0A9A              incf      Hi_Voltage,1
0204   0082  0B9B  vmrun0      decfsz    Avg_Counter,1
0205   0083  2947              goto      vlchk
0206   0084  3008              movlw     8
0207   0085  009B              movwf     Avg_Counter
0208   0086  1E0C              btfss     Reg_C,POWER_AVAILABLE
0209   0087  2947              goto      vlchk
0210   0088  120C              bcf       Reg_C,POWER_AVAILABLE
0211   0089  0C9A              rrf       Hi_Voltage,1
0212   008A  0C99              rrf       Last_Voltage,1
0213   008B  0C9A              rrf       Hi_Voltage,1
0214   008C  0C99              rrf       Last_Voltage,1
0215   008D  0C9A              rrf       Hi_Voltage,1
0216   008E  0C99              rrf       Last_Voltage,1
0217   008F  019A              clrf      Hi_Voltage
0218   0090  0819              movf      Last_Voltage,0
0219   0091  3C80              sublw     80h
0220   0092  009D              movwf     Amount;amount is neg for
0221   0093  1903              btfsc     STATUS,Z ;too much power
0222   0094  2944              goto      vmrun1
0223   0095  1C03              btfss     STATUS,C
0224   0096  28EC              goto      incvmpwr; too much power
0225   0097  0813  go_one      movf      Last_Amount,0
0226   0098  021D              subwf     Amount,0
0227   0099  1C03              btfss     STATUS,C
0228   009A  2944              goto      vmrun1
```

16c5x/xx Cross-Assembler V4.14 Released Tue Apr 30 13:11:47 1996 Page 5

```
Line   PC    Opcode
0229   009B  1903              btfsc    STATUS,Z
0230   009C  28A4              goto     go_one_1
0231   009D  1B9D              btfsc    Amount,7
0232   009E  28A4              goto     go_one_1
0233   009F  1003              bcf      STATUS,C
0234   00A0  39F8              andlw    0xf8
0235   00A1  1D03              btfss    STATUS,Z
0236   00A2  0D9D              rlf      Amount,1
0237   00A3  0D9D              rlf      Amount,1
0238   00A4  1D0C  go_one_1    btfss    Reg_C,POWER_ONE_FLAG
0239   00A5  28B6              goto     less_gain_down
0240   00A6  1B9D              btfsc    Amount,7;too little power
0241   00A7  28C6              goto     down64
0242   00A8  1B1D              btfsc    Amount,6
0243   00A9  28C6              goto     down64
0244   00AA  1A9D              btfsc    Amount,5
0245   00AB  28C8              goto     down32
0246   00AC  1A1D              btfsc    Amount,4
0247   00AD  28CA              goto     down16
0248   00AE  199D              btfsc    Amount,3
0249   00AF  28CC              goto     down8
0250   00B0  191D              btfsc    Amount,2
0251   00B1  28CE              goto     down4
0252   00B2  189D              btfsc    Amount,1
0253   00B3  28D2              goto     down1
0254   00B4  3001              movlw    1
0255   00B5  28D3              goto     down
0256                 less_gain_down
0257   00B6  1B9D              btfsc    Amount,7;too little power
0258   00B7  28C6              goto     down64
0259   00B8  1B1D              btfsc    Amount,6
0260   00B9  28C6              goto     down64
0261   00BA  1A9D              btfsc    Amount,5
0262   00BB  28C8              goto     down32
0263   00BC  1A1D              btfsc    Amount,4
0264   00BD  28CA              goto     down16
0265   00BE  199D              btfsc    Amount,3
0266   00BF  28CC              goto     down8
0267   00C0  191D              btfsc    Amount,2
0268   00C1  28D0              goto     down2
0269   00C2  189D              btfsc    Amount,1
0270   00C3  28D2              goto     down1
0271   00C4  3000              movlw    0
0272   00C5  28D3              goto     down
0273   00C6  3040  down64      movlw    64
0274   00C7  28D3              goto     down
0275   00C8  3020  down32      movlw    32
0276   00C9  28D3              goto     down
0277   00CA  3010  down16      movlw    16
0278   00CB  28D3              goto     down
0279   00CC  3008  down8       movlw    8
0280   00CD  28D3              goto     down
0281   00CE  3004  down4       movlw    4
0282   00CF  28D3              goto     down
0283   00D0  3002  down2       movlw    2
0284   00D1  28D3              goto     down
0285   00D2  3001  down1       movlw    1
```

16c5x/xx Cross-Assembler V4.14 Released Tue Apr 30 13:11:47 1996 Page 6

```
Line   PC    Opcode
0286   00D3  190C  down        btfsc    Reg_C,POWER_ONE_FLAG
0287   00D4  28DD              goto     down_power_one
0288   00D5  028F              subwf    Power_Set,1
0289   00D6  1803              btfsc    STATUS,C
0290   00D7  2944              goto     vmrun1
0291   00D8  080F              movf     Power_Set,0
0292   00D9  079E              addwf    Power_One_Set,1
0293   00DA  150C              bsf      Reg_C,POWER_ONE_FLAG
0294   00DB  018F              clrf     Power_Set
0295   00DC  2944              goto     vmrun1
0296                down_power_one
0297   00DD  198C              btfsc    Reg_C,POWER_TWO_FLAG
0298   00DE  28E7              goto     down_power_two
0299   00DF  029E              subwf    Power_One_Set,1
0300   00E0  1803              btfsc    STATUS,C
0301   00E1  2944              goto     vmrun1
0302   00E2  081E              movf     Power_One_Set,0
0303   00E3  0790              addwf    Power_Two_Set,1
0304   00E4  158C              bsf      Reg_C,POWER_TWO_FLAG
0305   00E5  019E              clrf     Power_One_Set
0306   00E6  2944              goto     vmrun1
0307                down_power_two
0308   00E7  0290              subwf    Power_Two_Set,1
0309   00E8  1803              btfsc    STATUS,C
0310   00E9  2944              goto     vmrun1
0311   00EA  0190              clrf     Power_Two_Set
0312   00EB  2944              goto     vmrun1
0313   00EC  081D  incvmpwr    movf     Amount,0
0314   00ED  0213              subwf    Last_Amount,0
0315   00EE  1C03              btfss    STATUS,C
0316   00EF  2944              goto     vmrun1
0317   00F0  1903              btfsc    STATUS,Z
0318   00F1  28F9              goto     incv
0319   00F2  1F1D              btfss    Amount,6
0320   00F3  28F9              goto     incv
0321   00F4  1003              bcf      STATUS,C
0322   00F5  39F8              andlw    0xf8
0323   00F6  1D03              btfss    STATUS,Z
0324   00F7  0D9D              rlf      Amount,1
0325   00F8  0D9D              rlf      Amount,1
0326   00F9  1D0C  incv        btfss    Reg_C,POWER_ONE_FLAG
0327   00FA  290B              goto     less_gain_up
0328   00FB  1F1D              btfss    Amount,6 ;too much power
0329   00FC  291B              goto     up64     ;bit7 is always set
0330   00FD  1E9D              btfss    Amount,5
0331   00FE  291B              goto     up64
0332   00FF  1E1D              btfss    Amount,4
0333   0100  291D              goto     up32
0334   0101  1D9D              btfss    Amount,3
0335   0102  291F              goto     up16
0336   0103  1D1D              btfss    Amount,2
0337   0104  2921              goto     up8
0338   0105  1C9D              btfss    Amount,1
0339   0106  2925              goto     up2
0340   0107  1C1D              btfss    Amount,0
0341   0108  2927              goto     up1
0342   0109  3001              movlw    1
```

```
16c5x/xx Cross-Assembler V4.14 Released  Tue Apr 30 13:11:47 1996  Page 7

Line   PC    Opcode

0343   010A  2928              goto      up
0344                 less_gain_up
0345   010B  1F1D              btfss     Amount,6
0346   010C  291B              goto      up64
0347   010D  1E9D              btfss     Amount,5
0348   010E  291B              goto      up64
0349   010F  1E1D              btfss     Amount,4
0350   0110  291D              goto      up32
0351   0111  1D9D              btfss     Amount,3
0352   0112  291F              goto      up16
0353   0113  1D1D              btfss     Amount,2
0354   0114  2921              goto      up8
0355   0115  1C9D              btfss     Amount,1
0356   0116  2925              goto      up2
0357   0117  1C1D              btfss     Amount,0
0358   0118  2927              goto      up1
0359   0119  3000              movlw     0
0360   011A  2928              goto      up
0361                 ;
0362   011B  3040  up64        movlw     64
0363   011C  2928              goto      up
0364   011D  3020  up32        movlw     32
0365   011E  2928              goto      up
0366   011F  3010  up16        movlw     16
0367   0120  2928              goto      up
0368   0121  3008  up8         movlw     8
0369   0122  2928              goto      up
0370   0123  3004  up4         movlw     4
0371   0124  2928              goto      up
0372   0125  3002  up2         movlw     2
0373   0126  2928              goto      up
0374   0127  3001  up1         movlw     1
0375   0128  190C  up          btfsc     Reg_C,POWER_ONE_FLAG
0376   0129  2930              goto      up_power_one
0377   012A  078F  upit        addwf     Power_Set,1
0378   012B  1C03              btfss     STATUS,C
0379   012C  2944              goto      vmrun1
0380   012D  30FF              movlw     0ffH
0381   012E  008F              movwf     Power_Set
0382   012F  2944              goto      vmrun1
0383                 up_power_one
0384   0130  198C              btfsc     Reg_C,POWER_TWO_FLAG
0385   0131  293B              goto      up_power_two
0386   0132  079E              addwf     Power_One_Set,1
0387   0133  1C03              btfss     STATUS,C
0388   0134  2944              goto      vmrun1
0389   0135  110C              bcf       Reg_C,POWER_ONE_FLAG
0390   0136  081E              movf      Power_One_Set,0
0391   0137  008F              movwf     Power_Set
0392   0138  30FF              movlw     0ffh
0393   0139  009E              movwf     Power_One_Set
0394   013A  2944              goto      vmrun1
0395                 up_power_two
0396   013B  0790              addwf     Power_Two_Set,1
0397   013C  1F90              btfss     Power_Two_Set,7
0398   013D  2944              goto      vmrun1
0399   013E  3080              movlw     80H
```

```
16c5x/xx Cross-Assembler V4.14 Released  Tue Apr 30 13:11:47 1996  Page 8

Line    PC     Opcode

0400    013F   0210              subwf     Power_Two_Set,0
0401    0140   009E              movwf     Power_One_Set
0402    0141   3080              movlw     80H
0403    0142   0090              movwf     Power_Two_Set
0404    0143   118C              bcf       Reg_C,POWER_TWO_FLAG
0405    0144   0199   vmrun1     clrf      Last_Voltage
0406    0145   081D              movf      Amount,0
0407    0146   0093              movwf     Last_Amount
0408    0147   1206   vlchk      bcf       Port_B,Vtest_4
0409    0148   2872              goto      start
0410                  ;
0411           0000          end
```

16c5x/xx Cross-Assembler V4.14 Released Tue Apr 30 13:11:47 1996 Page 9

Cross-Reference Listing

| LABEL | VALUE | DEFN | REFERENCES | | | | | |
|---|---|---|---|---|---|---|---|---|
| ADIF | 1 | 29 | 29 | | | | | |
| Adcon0 | 8 | 28 | 28 | 194 | 196 | 197 | | |
| Adcon1 | 8 | 34 | 34 | 85 | | | | |
| Adres | 9 | 33 | 33 | 199 | | | | |
| Amount | 29 | 66 | 66 | 220 | 226 | 231 | 236 | 237 |
| | | | 240 | 242 | 244 | 246 | 248 | 250 |
| | | | 252 | 257 | 259 | 261 | 263 | 265 |
| | | | 267 | 269 | 313 | 319 | 324 | 325 |
| | | | 328 | 330 | 332 | 334 | 336 | 338 |
| | | | 340 | 345 | 347 | 349 | 351 | 353 |
| | | | 355 | 357 | 406 | | | |
| Amount_Mag | 20 | 57 | 57 | | | | | |
| Avg_Counter | 27 | 64 | 64 | 103 | 204 | 207 | | |
| Base_Counter | 24 | 61 | 61 | 99 | 126 | 129 | 135 | 141 |
| | | | 147 | 158 | | | | |
| C | 0 | 13 | 13 | 201 | 223 | 227 | 233 | 289 |
| | | | 300 | 309 | 315 | 321 | 378 | 387 |
| DONE | 2 | 31 | 31 | 197 | | | | |
| GO_BIT | 2 | 30 | 30 | 196 | | | | |
| Hi_Voltage | 26 | 63 | 63 | 100 | 203 | 211 | 213 | 215 |
| | | | 217 | | | | | |
| INTF | 1 | 36 | 36 | 121 | 164 | | | |
| Intcon | 11 | 35 | 35 | 106 | 121 | 164 | 181 | |
| Last_Amount | 19 | 56 | 56 | 225 | 314 | 407 | | |
| Last_Voltage | 25 | 62 | 62 | 101 | 200 | 212 | 214 | 216 |
| | | | 218 | 405 | | | | |
| POWER_AVAILA | 4 | 48 | 48 | 161 | 208 | 210 | | |
| POWER_ONE_FL | 2 | 46 | 46 | 238 | 286 | 293 | 326 | 375 |
| | | | 389 | | | | | |
| POWER_TWO_FL | 3 | 47 | 47 | 297 | 304 | 384 | 404 | |
| PWR_ON_FLAG | 0 | 44 | 44 | 124 | 162 | 168 | 171 | 174 |
| Page_1 | 5 | 39 | 39 | 78 | 86 | | | |
| Port_A | 5 | 14 | 14 | | | | | |
| Port_B | 6 | 16 | 16 | 87 | 104 | 123 | 130 | 150 |
| | | | 163 | 166 | 170 | 175 | 185 | 192 |
| | | | 408 | | | | | |
| Power_Counte | 14 | 51 | 51 | 89 | 144 | 148 | 152 | |
| Power_One | 28 | 65 | 65 | 91 | 138 | 142 | 154 | |
| Power_One_Se | 30 | 67 | 67 | 90 | 153 | 292 | 299 | 302 |
| | | | 305 | 386 | 390 | 393 | 401 | |
| Power_Set | 15 | 52 | 52 | 92 | 151 | 288 | 291 | 294 |
| | | | 377 | 381 | 391 | | | |
| Power_Two | 17 | 54 | 54 | 95 | 132 | 136 | 156 | |
| Power_Two_Se | 16 | 53 | 53 | 94 | 155 | 303 | 308 | 311 |
| | | | 396 | 397 | 400 | 403 | | |
| RTCC | 1 | 10 | 10 | 120 | | | | |
| RUN_AD | 1 | 45 | 45 | 180 | 188 | 190 | | |
| Reaction_Set | 1 | 41 | 41 | | | | | |
| Reg_C | 12 | 43 | 43 | 76 | 124 | 161 | 162 | 168 |
| | | | 171 | 174 | 180 | 188 | 190 | 208 |
| | | | 210 | 238 | 286 | 293 | 297 | 304 |
| | | | 326 | 375 | 384 | 389 | 404 | |
| Ropt | 1 | 38 | 38 | 84 | | | | |
| STATUS | 3 | 11 | 11 | 78 | 86 | 117 | 127 | 133 |
| | | | 139 | 145 | 183 | 201 | 221 | 223 |
| | | | 227 | 229 | 233 | 235 | 289 | 300 |
| | | | 309 | 315 | 317 | 321 | 323 | 378 |
| | | | 387 | | | | | |
| Save_Status | 21 | 58 | 58 | 118 | 182 | | | |

| | | | | | | | | |
|---|---|---|---|---|---|---|---|---|
| Save_W | 22 | 59 | 59 | 116 | 184 | | | |
| Set_RTCC | 228 | 40 | 40 | 119 | | | | |
| T0IF | 2 | 37 | 37 | 181 | | | | |
| Time_Thru | 13 | 50 | 50 | 77 | | | | |
| Timer | 23 | 60 | 60 | 110 | 112 | | | |
| Tris_A | 5 | 25 | 25 | 80 | | | | |
| Tris_B | 6 | 26 | 26 | 82 | | | | |
| V1_Power | 7 | 18 | 18 | | | | | |
| V2_Power | 6 | 19 | 19 | | | | | |
| V_Master_Ctr | 18 | 55 | 55 | 97 | 160 | 176 | 179 | |
| Vmain | 3 | 17 | 17 | 104 | 130 | 170 | 175 | |
| Vtest_1 | 1 | 20 | 20 | 150 | 163 | | | |
| Vtest_2 | 2 | 21 | 21 | 123 | 185 | | | |
| Vtest_4 | 4 | 22 | 22 | 192 | 408 | | | |
| Vtest_5 | 5 | 23 | 23 | | | | | |
| Z | 2 | 12 | 12 | 127 | 133 | 139 | 145 | 221 |
| | | | 229 | 235 | 317 | 323 | | |
| down | 211 | 286 | 255 | 272 | 274 | 276 | 278 | 280 |
| | | | 282 | 284 | 286 | | | |
| down1 | 210 | 285 | 253 | 270 | 285 | | | |
| down16 | 202 | 277 | 247 | 264 | 277 | | | |
| down2 | 208 | 283 | 268 | 283 | | | | |
| down32 | 200 | 275 | 245 | 262 | 275 | | | |
| down4 | 206 | 281 | 251 | 281 | | | | |
| down64 | 198 | 273 | 241 | 243 | 258 | 260 | 273 | |
| down8 | 204 | 279 | 249 | 266 | 279 | | | |
| down_power_o | 221 | 296 | 287 | 296 | | | | |
| down_power_t | 231 | 307 | 298 | 307 | | | | |
| endit | 108 | 181 | 177 | 181 | | | | |
| endit0 | 109 | 182 | 165 | 182 | | | | |
| go_one | 151 | 225 | 225 | | | | | |
| go_one_1 | 164 | 238 | 230 | 232 | 238 | | | |
| incv | 249 | 326 | 318 | 320 | 326 | | | |
| incvmpwr | 236 | 313 | 224 | 313 | | | | |
| init | 5 | 75 | 70 | 75 | | | | |
| int0 | 44 | 116 | 74 | 116 | | | | |
| int10 | 72 | 144 | 140 | 144 | | | | |
| int11 | 60 | 132 | 128 | 132 | | | | |
| int12 | 66 | 138 | 134 | 138 | | | | |
| intend | 103 | 176 | 131 | 137 | 143 | 149 | 172 | 176 |
| less_gain_do | 182 | 256 | 239 | 256 | | | | |
| less_gain_up | 267 | 344 | 327 | 344 | | | | |
| set_0 | 78 | 150 | 122 | 150 | | | | |
| sta_off | 102 | 175 | 125 | 169 | 175 | | | |
| sta_off_now | 101 | 173 | 167 | 173 | | | | |
| start | 114 | 188 | 107 | 188 | 189 | 409 | | |
| turn_on | 94 | 166 | 146 | 166 | | | | |
| up | 296 | 375 | 343 | 360 | 363 | 365 | 367 | 369 |
| | | | 371 | 373 | 375 | | | |
| up1 | 295 | 374 | 341 | 358 | 374 | | | |
| up16 | 287 | 366 | 335 | 352 | 366 | | | |
| up2 | 293 | 372 | 339 | 356 | 372 | | | |
| up32 | 285 | 364 | 333 | 350 | 364 | | | |
| up4 | 291 | 370 | 370 | | | | | |
| up64 | 283 | 362 | 329 | 331 | 346 | 348 | 362 | |
| up8 | 289 | 368 | 337 | 354 | 368 | | | |
| up_power_one | 304 | 383 | 376 | 383 | | | | |
| up_power_two | 315 | 395 | 385 | 395 | | | | |
| upit | 298 | 377 | 377 | | | | | |
| v1chk | 327 | 408 | 205 | 209 | 408 | | | |
| vmrun | 123 | 197 | 197 | 198 | | | | |
| vmrun0 | 130 | 204 | 202 | 204 | | | | |
| vmrun1 | 324 | 405 | 222 | 228 | 290 | 295 | 301 | 306 |
| | | | 310 | 312 | 316 | 379 | 382 | 388 |
| | | | 394 | 398 | 405 | | | |

| | | | | |
|---|---|---|---|---|
| wait_20 | 38 | 109 | 109 | 195 |
| wt_20 | 40 | 111 | 111 | 113 |

I claim:

1. A primary regulator for regulating a primary transformer in a power supply comprising:

a transformer for receiving an unregulated supply voltage;

a rectifier coupled to the transformer;

a voltage reference coupled to the rectifier;

a zero-crossing detector coupled to the transformer;

a processor coupled to the zero-crossing detector, the voltage reference and a load voltage sensor, the processor controlling a switching device coupled to the primary transformer wherein the processor controls the switching device to turn on the primary transformer for predetermined periods based on a zero-crossing signal and a detected load voltage; and wherein the detected load voltage is detected at the load voltage sensor, the load voltage sensor comprising a voltage sensing line in communication with an analog-to-digital converter coupled to the processor, and wherein the voltage sensing line is connected to a potentiometer for dividing down the load voltage.

2. The device of claim 1 wherein the processor determines a turn on time for turning on the switching device using a first routine.

3. The device of claim 2 wherein the first routine comprises:

measurement timing means for determining the times for taking a measurement of the load voltage;

load voltage averaging means for calculating an average load voltage over a predetermined period; and switching device controlling means for calculating an off time for the switching device based on the average load voltage.

4. The device of claim 1 wherein the switching device comprises a triac.

5. The device of claim 1 wherein the switching device comprises a silicon controlled rectifier (SCR).

6. The device of claim 1 wherein the switching device is coupled to the processor via a pulse transformer.

7. The device of claim 1 wherein the switching device is coupled to the processor via an optical coupler.

8. The device of claim 1 wherein the load voltage sensor comprises the analog-to-digital converter receiving a voltage on the voltage sensing line, the voltage sensing line connected in series with the potentiometer and a zener diode for reducing and dividing down the load voltage.

9. The device of claim 1 wherein the analog-to-digital converter is integrated in the processor.

10. A primary regulator circuit for use in regulating a primary transformer in an unregulated linear power supply comprising:

regulator transformer means for stepping down an unregulated AC supply voltage, the regular transformer means connected to the unregulated AC supply voltage;

rectifier means for rectifying the unregulated AC supply, the rectifier means coupled to the regulator transformer means;

means for detecting a zero-crossing of the unregulated AC supply voltage, the means for detecting a zero-crossing coupled to the regulator transformer;

means for sensing a load voltage of a load connected to the primary transformer; and means, responsive to the load voltage sensing means and the zero-crossing detecting means, for comparing a reference voltage to the load voltage and adjusting an on time of the primary transformer whereby a constant voltage is maintained at the load.

* * * * *

UNITED STATES PATENT AND TRADEMARK OFFICE

CERTIFICATE OF CORRECTION

PATENT NO. : 5,757,168

DATED : May 26, 1998

INVENTOR(S) : Donald P. DeVale

It is certified that error appears in the above-identified patent and that said Letters Patent is hereby corrected as shown below:

On the Title Page

In column 2, line 4, under "ABSTRACT", after "coupler" insert --.-- (period).

In column 1, line 17, after "device" insert --.-- (period).

In column 2, line 10, change ";" (semicolon) to --,-- (comma).

In column 2, line 67, change "," (comma) to --.-- (period).

In column 3, line 37, after "arts" insert --,-- (comma).

In column 3, line 62, change "is the fed" to --is then fed--.

In column 5, line 6, change "european" to --European--.

UNITED STATES PATENT AND TRADEMARK OFFICE

CERTIFICATE OF CORRECTION

PATENT NO. : 5,757,168

DATED : May 26, 1998

INVENTOR(S) : Donald P. DeVale

It is certified that error appears in the above-identified patent and that said Letters Patent is hereby corrected as shown below:

In column 7, line 30, after "transformer" insert --.-- (period).

In column 8, after line 15, take out extra spaces, and after line 28, take out extra spaces.

Signed and Sealed this

Sixth Day of June, 2000

*Attest:*

Q. TODD DICKINSON

*Attesting Officer*

*Director of Patents and Trademarks*